US011297438B2

(12) United States Patent
Otto et al.

(10) Patent No.: US 11,297,438 B2
(45) Date of Patent: Apr. 5, 2022

(54) ELECTRODYNAMIC ACOUSTIC TRANSDUCER HAVING A POLYGONAL MEMBRANE WITH IMPROVED COMPLIANCE

(71) Applicant: Sound Solutions International Co., Ltd., Beijing (CN)

(72) Inventors: Gustav Otto, Vienna (AT); Christian Klaubauf, Vienna (AT); Andreas Hintennach, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 16/655,234

(22) Filed: Oct. 17, 2019

(65) Prior Publication Data

US 2020/0128332 A1 Apr. 23, 2020

(30) Foreign Application Priority Data

Oct. 19, 2018 (AT) ..... A50910/2018

(51) Int. Cl.
*H04R 25/00* (2006.01)
*H04R 9/06* (2006.01)
(Continued)

(52) U.S. Cl.
CPC ..... *H04R 9/06* (2013.01); *H04R 7/12* (2013.01); *H04R 7/18* (2013.01); *H04R 9/025* (2013.01);
(Continued)

(58) Field of Classification Search
CPC ... H04R 9/06; H04R 7/12; H04R 7/18; H04R 9/025; H04R 9/045; H04R 2400/11; H04R 2207/00
(Continued)

(56) References Cited

U.S. PATENT DOCUMENTS 1,757,107 A 5/1930 Baltzley
2,442,791 A 6/1948 Wente
(Continued)

FOREIGN PATENT DOCUMENTS

CN 105554643 A 5/2016
CN 108337609 A 7/2018
WO 2018006535 A1 1/2018

OTHER PUBLICATIONS

First Office Action for Austrian priority application A50910/2018, dated Jan. 16, 2019.

*Primary Examiner* — Phylesha Dabney
(74) *Attorney, Agent, or Firm* — Dykema Gossett PLLC

(57) ABSTRACT

An electrodynamic acoustic transducer is disclosed, which comprises a frame and/or a housing, at least one coil and a magnet system, which is fixed to the frame and/or the housing and which is designed to generate a magnetic field through the coil. Furthermore, the electrodynamic acoustic transducer comprises a polygonal membrane, which in an inner portion is fixed to the at least one coil and which in an outer annular portion is fixed to the frame or the housing. A first distance between the outer annular portion and the inner portion at a longitudinal side of the polygonal membrane is smaller or greater than a second distance between the outer annular portion and the inner portion at a corner of the polygonal membrane.

18 Claims, 3 Drawing Sheets

(51) Int. Cl.

| | |
|---|---|
| ***H04R 7/12*** | (2006.01) |
| ***H04R 9/02*** | (2006.01) |
| ***H04R 9/04*** | (2006.01) |
| ***H04R 7/18*** | (2006.01) |

(52) U.S. Cl.
CPC ..... *H04R 9/045* (2013.01); *H04R 2400/11* (2013.01)

(58) Field of Classification Search
USPC ..... 381/398
See application file for complete search history.

(56) References Cited

U.S. PATENT DOCUMENTS

| | | | | |
|---|---|---|---|---|
| 7,275,620 | B1 | 10/2007 | Diedrich et al. | |
| 10,708,694 | B2 * | 7/2020 | Ilkorur | H04R 9/025 |
| 10,827,274 | B2 * | 11/2020 | Yang | H04R 7/04 |
| 2004/0007420 | A1 * | 1/2004 | Takahashi | H04R 7/20 181/171 |
| 2006/0239494 | A1 * | 10/2006 | Kimura | H04R 7/127 381/386 |
| 2008/0199028 | A1 * | 8/2008 | Takebe | H04R 7/125 381/190 |
| 2011/0311092 | A1 * | 12/2011 | Kosuda | H04R 7/06 381/398 |
| 2016/0014522 | A1 * | 1/2016 | Matsumura | H04R 7/18 381/398 |
| 2016/0227314 | A1 | 8/2016 | Cai et al. | |
| 2016/0227324 | A1 * | 8/2016 | Cai | H04R 7/14 |
| 2017/0347201 | A1 | 11/2017 | Linghu et al. | |
| 2017/0347204 | A1 | 11/2017 | Linghu et al. | |
| 2019/0075400 | A1 * | 3/2019 | Hintennach | H04R 7/06 |
| 2020/0045432 | A1 * | 2/2020 | Hu | H04R 9/02 |
| 2020/0128332 | A1 * | 4/2020 | Otto | H04R 9/045 |

* cited by examiner

ELECTRODYNAMIC ACOUSTIC TRANSDUCER HAVING A POLYGONAL MEMBRANE WITH IMPROVED COMPLIANCE

PRIORITY

This patent application claims priority to Austrian Patent Application No. A50910/2018, filed on Oct. 19, 2018, the disclosure of which is incorporated herein, in its entirety, by reference.

BACKGROUND OF THE INVENTION

The invention relates to an electrodynamic acoustic transducer, which comprises a frame and/or a housing, at least one coil, which has a coil wire being wound around a loop axis, and a magnet system, which is fixed to the frame and/or the housing and which is designed to generate a magnetic field transverse to a longitudinal extension of the coil wire and transverse to the loop axis. Furthermore, the electrodynamic acoustic transducer comprises a polygonal membrane, which in a inner portion is fixed to the at least one coil and which in an outer annular portion is fixed to the frame or the housing.

An electrodynamic acoustic transducer of said kind is generally known and widely used. Designers of electrodynamic acoustic transducers are confronted with the ever-increasing demands of the market, in particular with respect to sound power and sound quality. Both requires not just a well working drive in the form a magnet system and a coil but also a compliant membrane, which converts the movement of the coil into sound waves. The shape of the membrane substantially influences the achievable level of sound power and sound quality.

SUMMARY OF THE INVENTION

It is an object of the invention to provide an improved design for an electrodynamic acoustic transducer. In particular, the compliance of the membrane and thus sound power and sound quality shall be improved.

The problem of the invention is solved by an electrodynamic acoustic transducer as defined in the opening paragraph, wherein:

- a first distance, which is measured in direction of the loop axis between a first point in the outer annular portion and a second point in the inner portion, wherein the first point and the second point lay on a first ray, which originates from the loop axis and crosses a longitudinal side of the polygonal membrane, is smaller or greater than
- a second distance, which is measured in direction of the loop axis between a third point in the outer annular portion and a fourth point in the inner portion, wherein the third point and the fourth point lay on a second ray, which originates from the loop axis and crosses a corner of the polygonal membrane.

By the above measures, the length of the membrane in a bending corner section seen in a cross-sectional plane parallel to the loop axis is expanded in case the first distance is smaller than the second distance. In this way, the membrane becomes softer in the region of the corners of the polygonal membrane. Hence the sound power and sound quality is improved compared to known designs having the outer annular portion of the membrane in one single plane perpendicular to the loop axis. Furthermore, the offset in direction of the loop axis is an additional degree of freedom when designing a membrane. In that, the design of the membrane can be better adapted to the demanded characteristics of the electrodynamic acoustic transducer.

If the first distance is greater than the second distance, the above teaching equally applies to the longitudinal sides of the membrane. In detail, the membrane becomes softer in the region of the longitudinal sides of the polygonal membrane. Again, sound power and sound quality can be improved compared to known designs having the outer annular portion of the membrane in one single plane perpendicular to the loop axis. And again, the offset in direction of the loop axis is an additional degree of freedom when designing a membrane. That is why the design of the membrane can be better adapted to the demanded characteristics of the electrodynamic acoustic transducer.

The proposed design applies to speakers in general and particularly to micro speakers, whose membrane area is smaller than 600 $mm^2$ and/or whose back volume is in a range from 200 $mm^3$ to 2 $cm^3$. Such micro speakers are used in all kind of mobile devices such as mobile phones, mobile music devices, laptops and/or in headphones. A diameter of the coil wire beneficially is ≤110 μm in such cases so as to allow for compact coils with a high number of windings and for a proper movement of the membrane. It should be noted at this point, that a micro speaker does not necessarily comprise its own back volume but can use a space of a device, which the speaker is built into, as a back volume. That means the speaker does not comprise its own (closed) housing but just an (open) frame. The back volume of the devices, which such speakers are built into, typically is smaller than 10 $cm^3$.

The electrodynamic acoustic transducer may comprise a frame and/or a housing.

A "frame" commonly is a part, which holds together the membrane, the coil and the magnet system. Usually, the frame is directly connected to the membrane and the magnet system (e.g. by means of an adhesive), whereas the coil is connected to the membrane. Hence, the frame is fixedly arranged in relation to the magnet system. Normally, the frame together with the membrane, the coil and the magnet system forms a sub system, which is the result of an intermediate step in a production process.

A "housing" normally is mounted to the frame and/or to the membrane and encompasses the back volume of a transducer, i.e. an air or gas compartment behind the membrane. Hence, the housing is fixedly arranged in relation to the magnet system. In common designs, the housing can be hermetically sealed respectively air tight. However, it may also comprise small openings or bass tubes as the case may be. Inter alia by variation of the back volume respectively by provision of openings in the housing, the acoustic performance of the transducer can be influenced.

In a beneficial embodiment, positions of the outer annular portion measured in direction of the loop axis may continuously vary along a loop running in the outer annular portion around the loop axis. In this way, the characteristics of the membrane in the outer annular portion change smoothly.

Alternatively, positions of the outer annular portion measured in direction of the loop axis are the same at least in sections of a loop running in the outer annular portion around the loop axis. In particular the outer annular portion in the region of the longitudinal sides of the polygonal membrane is situated in a first plane, which is oriented perpendicular to the loop axis, and the outer annular portion in the region of the corners of the polygonal membrane is situated in a second plane, which is oriented perpendicular to the loop axis, too, and which is arranged at a distance from the first plane. This type of membrane is comparably easy to produce.

In the above case, the second plane can be arranged below the first plane. In this way, the electrodynamic transducer is particularly flat.

Alternatively, the second plane can be arranged above the first plane. In this way the expansion of the length of the membrane in a corner bending section seen in a cross-sectional plane parallel to the loop axis more or less may be chosen freely.

Beneficially, a transition from the first plane to the second plane runs along a S-curve. In this way, sharp bends, which may be prone to breakage, are avoided.

Beneficially, the (maximum) distance between the first plane and the second plane in a direction of the loop axis is at least 50 μm measured in the direction of the loop axis. In this way, the influence of the offset between the first and the second plane audible clearly. Moreover, the sound pressure may be significantly increased by the above measures. If the (side) magnets in a common design have a height of 0.5 mm, a difference of just 50 μm between the first plane and the second plane allows for (side) magnets being larger by 10%. In that, the sound pressure can be increased by 0.5 dB without increasing the overall height of the electrodynamic acoustic transducer.

Beneficially, the area of the outer annular portion in the first plane is at least two times the area of the outer annular portion in the second plane. In this way, the region of the longitudinal sides of the polygonal membrane are not influenced much by the offset between the first and the second plane.

Beneficially, the inner portion of the membrane lays in a center plane, which is oriented perpendicular to the loop axis. In this way, the membrane can easily be attached to the coil, and the membrane can also easily be attached to a stiffening plate as the case may be.

Beneficially, the polygonal membrane in the region of its corners comprises corrugations running from the inner portion to the outer annular portion of the polygonal membrane, and the polygonal membrane in the region of its longitudinal sides is free of corrugations. In this way, the membrane can be designed particularly soft in the corner regions thus improving the overall performance of the electrodynamic transducer. The corrugations may continuously run from the inner portion to the outer annular portion of the polygonal membrane or may discontinue. If they discontinue, a number of corrugations may be concatenated in their longitudinal extension (in particular with a space in-between) to cover the area from the inner portion to the outer annular portion. Moreover, the corrugations may run directly from the inner portion to the outer portion of the membrane and may be oriented radially or at least may comprise a radial component.

In a very advantageous embodiment of the electrodynamic acoustic transducer, the magnet system is only arranged in the region of the longitudinal sides of the polygonal membrane and discontinues in the region of the corners of the polygonal membrane. In other words, the magnet system generates a substantially strong magnetic field through the coil just in the region of the longitudinal sides of the polygonal membrane. In this way, the difference between the first distance and the second distance can be made particularly large, even in case that the second plane is arranged below the first plane. Accordingly, the characteristics of the membrane in its corner region can be improved much. That is why also the acoustic performance of the electrodynamic transducer substantially benefits from this embodiment. In particular, the sound pressure may be significantly increased by the above measures. If the (side) magnets in a common design have a height of 0.5 mm, a difference of just 50 μm between the first plane and the second plane allows for (side) magnets being larger by 10%. In that, the sound pressure can be increased by 0.5 dB without increasing the overall height of the electrodynamic acoustic transducer.

Finally, the corners of the polygonal membrane can be rounded in a beneficial embodiment of the electrodynamic transducer. In this way, the inhomogeneous influence of the corners is reduced.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
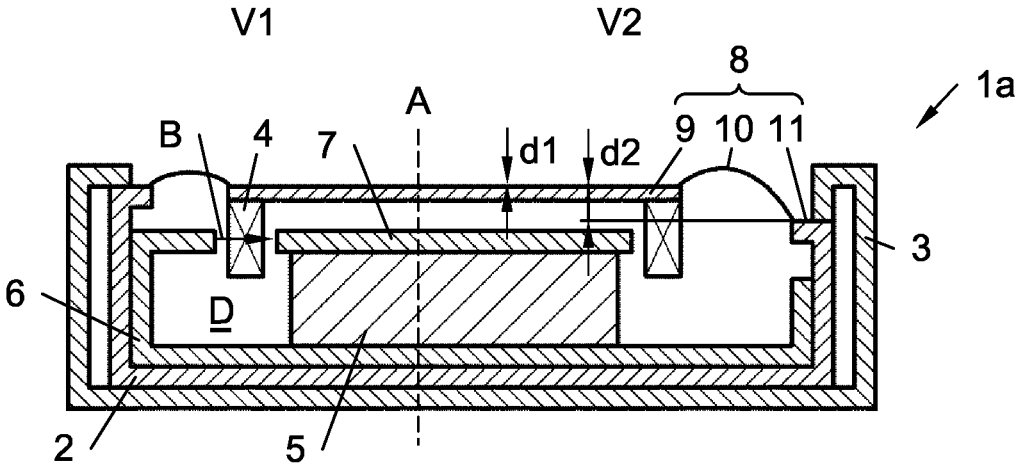
FIG. 1 shows a cross sectional view of a exemplary transducer both in the corner region and in the region of the longitudinal side of the transducer.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrase "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about" or "substantially", which particularly means a deviation of ±10% from a reference value.

FIG. 1 shows a cross sectional view of an example of an electrodynamic acoustic transducer 1*a*. The transducer 1*a* comprises a frame 2 and a housing 3 attached to the frame 2. Furthermore, the transducer 1*a* comprises a coil 4, which has a coil wire being wound around a loop axis A (note that the coil wire is not explicitly shown in FIG. 1). The electrodynamic transducer 1*a* also comprises a magnet 5, a pot plate 6 and a top plate 7 together forming a magnet system of the transducer 1*a*. The magnet system generates a magnetic field B transverse to a longitudinal extension of the coil wire and transverse to the loop axis A in a magnet gap between the pot plate 6 and the top plate 7. Finally, the electrodynamic transducer 1*a* comprises a polygonal membrane 8, which in a inner portion 9 is fixed to the at least one coil 4, which comprises a bending portion 10 and which in an outer annular portion 11 is fixed to the frame 2.

Figure 2:
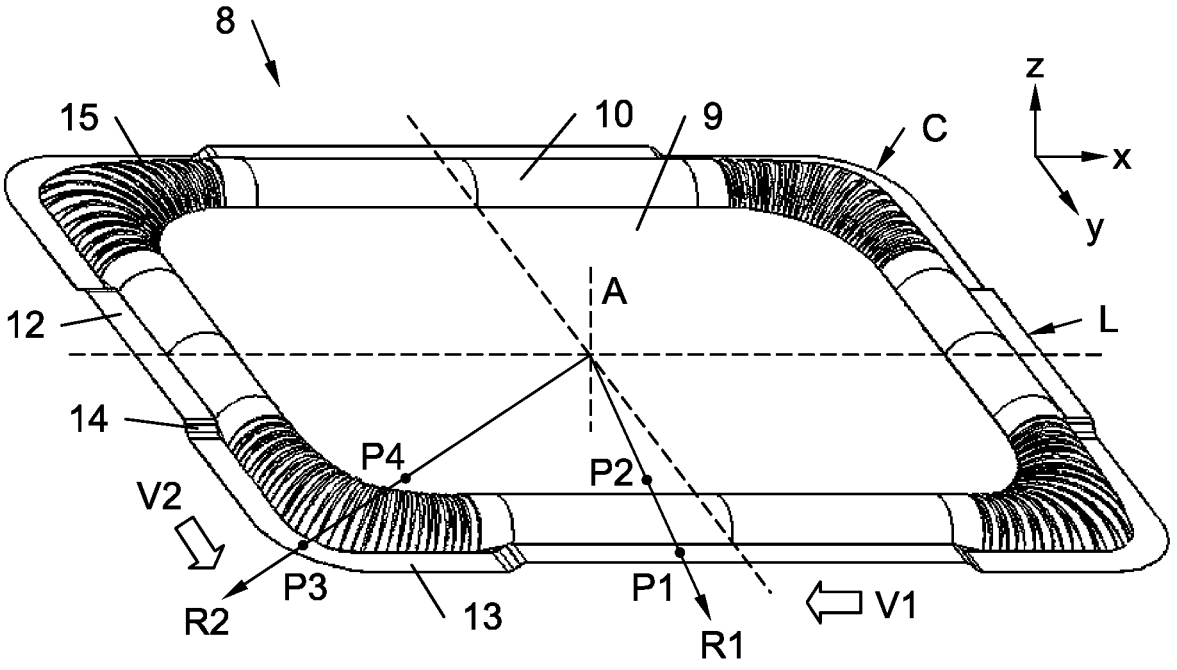
FIG. 2 shows an oblique view of an exemplary membrane.

FIG. 2 shows an oblique view of the membrane 8. In detail, FIG. 2 shows a first ray R1, which originates from the loop axis A and crosses a longitudinal side L of the polygonal membrane 8 and a second ray R2, which originates from the loop axis A and crosses a corner C of the polygonal membrane 8. Furthermore, FIG. 2 shows a first point P1 in the outer annular portion 11 and a second point P2 in the inner portion 9 laying on the first ray R1 and a third point P3 in the outer annular portion 11 and a fourth point P4 in the inner portion 9 laying on the second ray R2. A first distance d1 can be measured in direction of the loop axis A between the first point P1 and a second point P2, and a second distance d2 can be measured in direction of the loop axis A between the third point P3 and the fourth point P4. The first distance d1 is smaller than the second distance d2. In fact, the first distance d1 is zero in this example (what however is no necessary condition).

In this way, the outer annular portion 11 in the region of longitudinal sides L of the polygonal membrane 8, that is the longitudinal annular portion 12, is situated in a first plane, which is oriented perpendicular to the loop axis A, and the outer annular portion 11 in the region of corners C of the polygonal membrane 8, that is the corner annular portion 13, is situated in a second plane, which is oriented perpendicular to the loop axis A, too. Between the longitudinal annular portion 12 and the corner annular portion 13 there is a transition annular portion 14, in which a transition from the first plane to the second plane runs along a S-curve. Accordingly, breakage in the transition annular portion 14 can be avoided. Nevertheless, the transition annular portion 14 can also be designed in a different way.

In this example, the inner portion 9 lays in a center plane, which is oriented perpendicular to the loop axis A, too. In this way, the membrane 8 can easily be attached to the coil 4, and the membrane 8 can also easily be attached to a stiffening plate which is part of this example and arranged in the inner portion 9.

Furthermore, the polygonal membrane 8 in the region of its corners C comprises corrugations 15 running from the inner portion 9 to the outer annular portion 11 of the polygonal membrane 8, whereas the polygonal membrane 8 in the region of its longitudinal sides L is free of corrugations 15. In this way, the membrane 8 can be designed particularly soft in the region of its corners C thus improving the overall performance of the electrodynamic transducer 1*a*.

Additionally, the offset of the corner annular portion 13 in relation to the longitudinal annular portion 12 and/or in relation to the inner portion 9 provides an additional degree of freedom when designing a membrane 8. In that, the design of the membrane 8 can be better adapted to the demanded characteristics of the electrodynamic acoustic transducer 1*a*.

In this example, the corrugations 15 run directly from the inner portion 9 to the outer portion 11 of the membrane 8 and are oriented radially. However, the corrugations 15 may have a different orientation at least comprising a radial component. Moreover, the corrugations 15 continuously run from the inner portion 9 to the outer annular portion 11 of the polygonal membrane 8. Nevertheless, the corrugations 15 may discontinue, and a number of corrugations 15 may be concatenated in their longitudinal extension (in particular with a space in-between) to cover the area from the inner portion 9 to the outer annular portion 11.

Finally, the corners C of the polygonal membrane 8 are rounded in this example. In this way, the inhomogeneous influence of the corners C is reduced.

Figure 3:
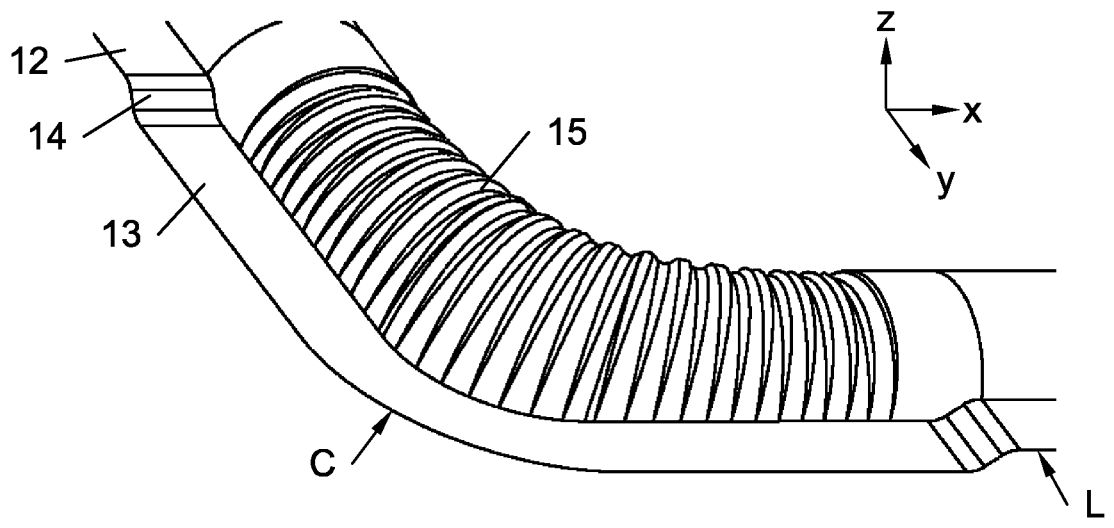
FIG. 3 shows the corner region of the membrane of FIG. 2 in detail.

FIG. 3 now shows the corner region of the membrane of FIG. 2 in more detail. In particular, the transition annular portion 14 and the corrugations 15 are clearly visible.

It should be noted at this point that in FIG. 2 two views V1 and V2 are indicated. These views are shown in FIG. 1. In detail, view V1 (and thus the longitudinal region L of the electrodynamic acoustic transducer 1*a*) is shown on the left side, whereas view V2 (and thus the corner region C of the electrodynamic acoustic transducer 1*a*) is shown on the right side. As such, FIG. 1 also clearly shows the first distance d1 and the second distance d2.

Figure 4:
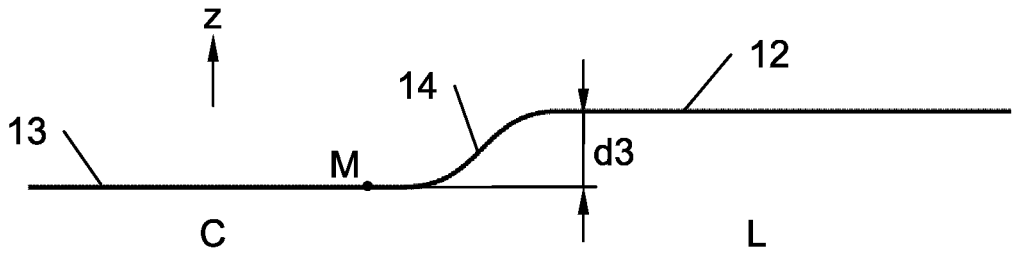
FIG. 4 shows a course of the edge of a membrane with the second plane below the first plane.
Figure 5:
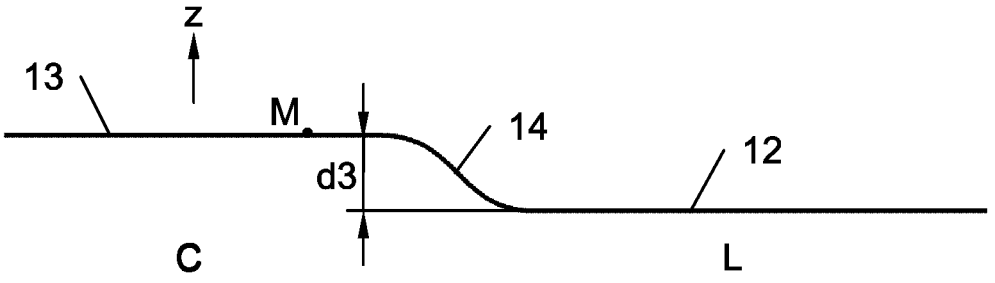
FIG. 5 shows a course of the edge of a membrane with the second plane above the first plane.

In the above example, the second plane (i.e. corner annular portion 13) is below the first plane (i.e. the longitudinal annular portion 12), which is clearly visible in FIG. 4 showing a course of the edge of the membrane 8. In detail, FIG. 4 shows the quarter of the total edge of the membrane 8. However, this is no necessary condition. Instead, the second plane (i.e. corner annular portion 13) may also be arranged above the first plane (i.e. the longitudinal annular portion 12), which is depicted in FIG. 5 showing the course of the edge of an alternative membrane. Both FIGS. 4 and 5 indicate the third distance d3, which is the distance between the first plane and the second plane and which is the difference between the first distance d1 and the second distance d2 (d3=d1−d2).

Generally, it is of advantage if the (maximum) distance d3 between the first plane (i.e. the longitudinal annular portion 12) and the second plane (i.e. corner annular portion 13) in a direction of the loop axis A (here in z-direction) is at least 50 μm measured in the direction of the loop axis A. In this way, the influence of the offset between the first and the second plane is clearly audible. Moreover, the sound pressure may be significantly increased by the above measures. If the (side) magnets (see the magnets 5*a* . . . 5*d* in FIG. 7) in a common design have a height of 0.5 mm, a difference of 50 μm between the first plane and the second plane allows for (side) magnets being larger by 10%. In that, the sound pressure can be increased by 0.5 dB without increasing the overall height of the electrodynamic acoustic transducer 1*a*.

Generally, it is also of advantage if the area of the outer annular portion 11 in the first plane (i.e. the longitudinal annular portion 12) is at least two times the area of the outer annular portion 11 in the second plane (i.e. corner annular portion 13). In this way, the region of the longitudinal sides of the polygonal membrane 8 are not influenced much by the offset between the first and the second plane.

Figure 6:
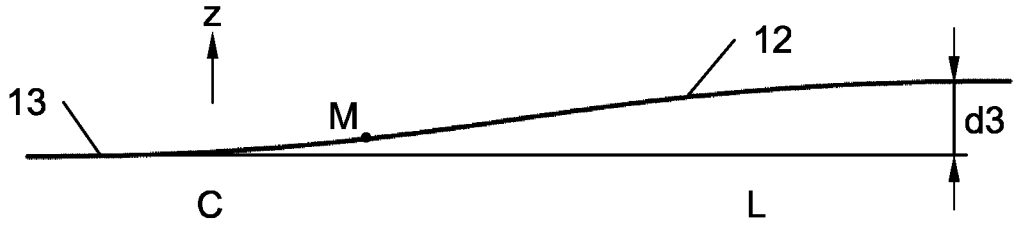
FIG. 6 shows a course of the edge of a membrane with continuously changing z-positions.

In the examples of FIGS. 1 to 5 positions M of the outer annular portion 11 measured in direction of the loop axis A are the same at least in sections of a loop running in the outer annular portion 11 around the loop axis A. In other words, this means that the z-positions of the edge of the membrane 8 are the same (in the longitudinal annular portion 12 and the corner annular portion 13). This is no necessary condition. Alternatively, positions M of the outer annular portion 11 measured in direction of the loop axis A may also continuously vary along a loop running in the outer annular portion 11 around the loop axis A as this is shown in FIG. 6.

It should be noted that although the membrane 8 of this example is fixed to the frame 2, the membrane 8 may also be attached to the housing 3 in an alternative embodiment. It should also be noted the frame 2 and the housing 3 are optional parts of the electrodynamic transducer 1*a* and the membrane 8 may also be attached to the magnet system, for example to the pot plate 6. The magnet system itself can be fixed to the frame 2 and/or the housing 3.

Figure 7:
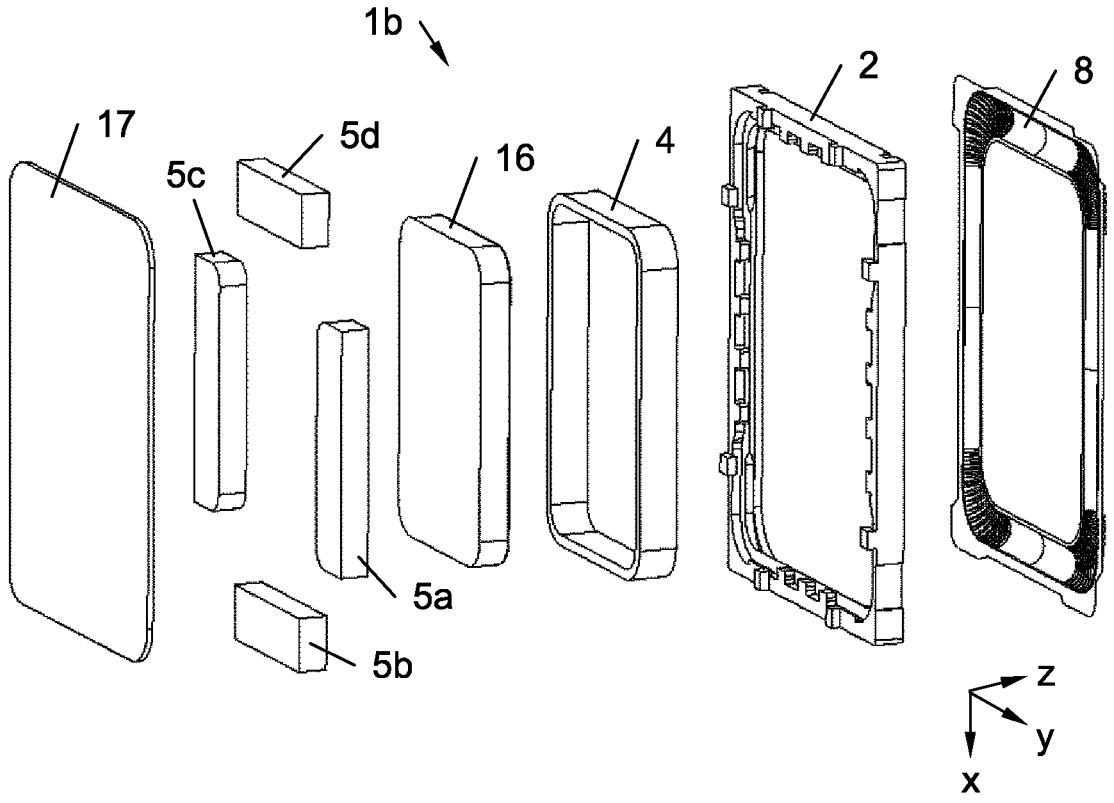
FIG. 7 shows an exploded view of a transducer with an alternative magnet system.

FIG. 7 finally shows an exploded view of a transducer 1*b* with an alternative magnet system. In detail, FIG. 7 shows a frame 2, a coil 4, a membrane 8, a center plate 16, a bottom plate 17 and four magnets 5*a* . . . 5*d*. Like in the example of FIGS. 1 to 4, the membrane 8 is fixed to the frame 2 and to the coil 4. The bottom plate 17 is fixed to the frame 2 as well. In turn, the center plate 17 and the four magnets 5*a* . . . 5*d* are fixed to the bottom plate 17. In this example the magnet system (in particular the magnets 5*a* . . . 5*d*) is only arranged in the region of the longitudinal sides L of the polygonal membrane 8 and discontinues in the region of the corners C of the polygonal membrane 8. In other words, the magnet system 5*a* . . . 5*d*, 16, 17 generates a substantially strong magnetic field through the coil 4 just in the region of the longitudinal sides L of the polygonal membrane 8. In this way, the third distance d3 (i.e. the difference between the first distance d1 and the second distance d2) can be made particularly large, even in case that the second plane is arranged below the first plane (see FIG. 4 and our explanations above in view of increasing the sound pressure by a sufficiently large distance d3).

The transducer 1*a*, 1*b* generally can be embodied as a loudspeaker and in particular as a micro speaker, whose membrane area is smaller than 600 $mm^2$ and/or whose back volume D is in a range from 200 $mm^3$ to 2 $cm^3$. A diameter of the coil wire beneficially is ≤110 μm in such cases so as to allow for compact coils 4 with a high number of windings and for a proper movement of the membrane 8. In this way, the electrodynamic transducer 1*a*, 1*b* may be used for all kind of mobile devices like mobile phones, laptops, earphones, etc.

In the examples shown hereinbefore, the first distance d1 is smaller than the second distance d2, and in particular the first distance d1 is zero. These are neither necessary nor mandatory conditions. Alternatively, the first distance d1 may be different to zero and/or the first distance d1 may be greater than the second distance d2. In particular, the second distance d2 may be zero. If the first distance d1 is greater than the second distance d2, the above teaching equally applies to the longitudinal sides L of the membrane 8. In detail, the membrane 8 becomes softer in the region of its longitudinal sides L then, and the sound power and the sound quality can be improved compared to known designs having the outer annular portion 11 of the membrane 8 in one single plane perpendicular to the loop axis A. Furthermore, the offset of the longitudinal annular portion 12 in relation to the corner annular portion 13 and/or in relation to the inner portion 9 provides an additional degree of freedom when designing a membrane 8. That is why the design of the membrane 8 can be better adapted to the demanded characteristics of the electrodynamic acoustic transducer 1*a*, 1*b*.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention.

The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

LIST OF REFERENCES

1*a*, 1*b* ectrodynamic acoustic transducer
2 frame
3 housing
4 coil
5, 5*a* . . . 5*d* magnet
6 pot plate
7 top plate
8 membrane
9 inner portion
10 bending portion
11 outer annular portion
12 longitudinal annular portion
13 corner annular portion
14 transition annular portion
15 corrugation
16 center plate
17 bottom plate
A loop axis
B magnetic field
C corner of the polygonal membrane
D back volume
d1 first distance
d2 second distance
d3 third distance
L longitudinal side of the polygonal membrane
M position or coordinate on the outer annular portion
P1 . . . P4 point on ray
R1, R2 ray
V1, V2 view
x, y, z axes of coordinate system

The invention claimed is:

1. Electrodynamic acoustic transducer, comprising:
a frame and/or a housing;
at least one coil, which has a coil wire being wound around a loop axis;
a magnet system, which is fixed to the frame and/or the housing and which is designed to generate a magnetic field transverse to a longitudinal extension of the coil wire and transverse to the loop axis;
a polygonal membrane, which in an inner portion is fixed to the at least one coil and which in an outer annular portion is fixed to the frame or the housing;
characterized in that
a first point located in the outer annular portion on a longitudinal side of the polygonal membrane, is above or below, as measured in the direction of the loop axis, than
a second point located in the outer annular portion on a corner of the polygonal membrane.

2. Electrodynamic acoustic transducer according to claim 1, characterized in that positions of the outer annular portion measured in direction of the loop axis continuously vary along a loop running in the outer annular portion around the loop axis.

3. Electrodynamic acoustic transducer according to claim 1, characterized in that positions of the outer annular portion measured in direction of the loop axis are the same at least in sections of a loop running in the outer annular portion around the loop axis.

4. Electrodynamic acoustic transducer according to claim 3, characterized in that the outer annular portion in the region of longitudinal sides of the polygonal membrane is situated in a first plane, which is oriented perpendicular to the loop axis, and the outer annular portion in the region of corners of the polygonal membrane is situated in a second plane, which is oriented perpendicular to the loop axis, too, and which is arranged at a distance from the first plane, as measured in the direction of the loop axis.

5. Electrodynamic acoustic transducer according to claim 4, characterized in that the second plane is below the first plane.

6. Electrodynamic acoustic transducer according to claim 4, characterized in that the second plane is above the first plane.

7. Electrodynamic acoustic transducer according to claim 4, characterized in that a transition from the first plane to the second plane runs along a S-curve.

8. Electrodynamic acoustic transducer according to claim 4, characterized in that the distance between the first plane and the second plane in a direction of the loop axis is at least 50 μm measured in the direction of the loop axis.

9. Electrodynamic acoustic transducer according to claim 4 characterized in that the area of the outer annular portion in the first plane is at least two times the area of the outer annular portion in the second plane.

10. Electrodynamic acoustic transducer according to claim 1, characterized in that the inner portion lays in a center plane, which is oriented perpendicular to the loop axis.

11. Electrodynamic acoustic transducer according to claim 1, characterized in that the polygonal membrane in the region of its corners comprises corrugations of the polygonal membrane, and the polygonal membrane in the region of its longitudinal sides is free of corrugations.

12. Electrodynamic acoustic transducer according to claim 1, characterized in that the magnet system is arranged in the region of the longitudinal sides of the polygonal membrane and discontinues in the region of the corners of the polygonal membrane.

13. Electrodynamic acoustic transducer according to claim 1, characterized in that the corners of the polygonal membrane are rounded.

14. Electrodynamic acoustic transducer as claimed in claim 1, characterized in that the area of the membrane seen in a direction parallel to the loop axis is smaller than 600 $mm^2$ and/or the back volume of the transducer is in a range from 200 $mm^3$ to 2 $cm^3$.

15. Electrodynamic acoustic transducer as claimed in claim 1, characterized in that a diameter of the coil wire is ≤110 μm.

16. An electrodynamic acoustic transducer, comprising:
a frame and/or a housing;
at least one coil, which has a coil wire being wound around a loop axis;
a magnet system, which is fixed to the frame and/or the housing and which is designed to generate a magnetic field transverse to a longitudinal extension of the coil wire and transverse to the loop axis;

a polygonal membrane, which in an inner portion is fixed to the at least one coil and which in an outer annular portion is fixed to the frame or the housing;

wherein the outer annular portion in the region of longitudinal sides of the polygonal membrane is situated in a first plane perpendicular to the loop axis, and the outer annular portion in the region of corners of the polygonal membrane is situated in a second plane perpendicular to the loop axis, wherein the second plane is located above or below the first plane as measured in the direction of the loop axis.

17. The electrodynamic acoustic transducer of claim 16, wherein the second plane is above the first plane.

18. The electrodynamic acoustic transducer of claim 16, wherein the second plane is below the first plane.

* * * * *